US005440842A

United States Patent [19]

Sorkin

[11] Patent Number: 5,440,842

[45] Date of Patent: Aug. 15, 1995

[54] SEALED TENDON-TENSIONING ANCHOR SYSTEM

[75] Inventor: Felix L. Sorkin, 2918 Fairway Dr., Sugarland, Tex. 77478

[73] Assignee: Felix L. Sorkin, Houston, Tex.

[21] Appl. No.: 987,636

[22] Filed: Dec. 9, 1992

[51] Int. Cl.[6] ..... E04C 3/10

[52] U.S. Cl. ..... 52/223.13

[58] Field of Search ..... 52/223.13, DIG. 12, 52/244; 24/122.6

[56] References Cited

U.S. PATENT DOCUMENTS

| | | | |
|---|---|---|---|
| 4,348,844 | 9/1982 | Schupack et al. | 52/230 |
| 4,363,462 | 12/1982 | Wlodkowski et al. | 249/190 |
| 4,561,226 | 12/1985 | Tourneur | 52/223 |
| 4,616,458 | 10/1986 | Davis et al. | 52/230 |
| 4,619,088 | 10/1986 | Ripoll Garcia-Mansilla | 52/223.13 |
| 4,719,658 | 1/1988 | Kriofske | 52/223 |
| 4,773,198 | 9/1988 | Reinhardt | 52/223 |
| 4,821,474 | 4/1989 | Rodriguez | 52/223.13 |
| 4,896,470 | 1/1990 | Sorkin | 52/230 |
| 4,918,887 | 4/1990 | Davis et al. | 52/223 |
| 5,024,032 | 6/1991 | Rodriguez | 52/223 |
| 5,072,558 | 12/1991 | Sorkin | 52/230 |
| 5,079,879 | 1/1992 | Rodriguez | 52/223.13 |

OTHER PUBLICATIONS

"Mono-Strand Corrosion Protection System" brochure, Varitech Industries, Inc., 1 sheet, 1991.

*Primary Examiner*—Jerry Redman

*Attorney, Agent, or Firm*—Vinson & Elkins

[57] ABSTRACT

An apparatus for sealing an anchor retaining a tendon is disclosed, whereby an end of the tendon extends from the anchor. The apparatus comprises a vessel member having a void and a rust inhibitor disposed within the void. Further, the apparatus includes a retaining member permanently affixed to the vessel member whereby the retaining member is punctured by the tendon end upon placing the vessel in sealed communication with the anchor.

13 Claims, 2 Drawing Sheets

SEALED TENDON-TENSIONING ANCHOR SYSTEM

TECHNICAL FIELD OF THE INVENTION

The present invention relates in general to tendon-tensioning anchor systems, and more particularly to an improved assembly for providing rust inhibitors to the anchor cavity.

BACKGROUND OF THE INVENTION

Over the years, the design of concrete structures has evolved and vastly improved. Various mechanisms for reinforcing concrete structures have been tested and implemented to augment the concrete tensile strength. As known in the art, reinforced concrete reaches its highest potential when it is used in a prestress or post-tensioned fashion. In prestressing, reinforcing tendons of high tensile strength wires or similar materials are stretched to a certain predetermined limit and then high-strength concrete is placed around them. When the concrete is set, it holds the steel in tight grip, preventing slippage or sagging. Post-tensioning follows a similar principle but the reinforcing tendons are held loosely in place while the concrete is placed around them. After the concrete cures, the reinforcing tendons are stretched by hydraulic jacks and securely anchored into place. Prestressing is done with individual members in the shop while post-tensioning is part of the structure on the site.

FIG. 1 illustrates various components of a typical post-tension assembly designated generally at 10. System 10 includes a tendon 12 having an exposed end 13 protruding from a sheath 14. End 13 of tendon 12 is typically fitted through an extension tube 16. Extension tube 16 has a diameter slightly larger than sheath 14 such that one end **16*a* of tube 16 may overlie sheath 14. The opposite end 16*b* of tube 16 fits over, and communicates with, a rear tubular portion 18 of an anchor 20. Rear tubular member 18 includes an aperture (not shown) which communicates with a frontal aperture 22. Frontal aperture 22 defines a cavity in which wedges 24 and 26 are disposed, as shown in FIG. 2**, below.

FIG. 2 illustrates an assembled view (in one-fourth cutaway perspective) of system 10 shown in FIG. 1. As known in the art, tendon 12 is disposed through extension tube 16 and through anchor 20. In one known embodiment, end **16*b* of extension tube 16 is force-fitted over rear tubular member 18. The other end 16*a* of extension tube 16 is sealed to sheath 14**, by use of tape or other means.

After tendon 18 extends through frontal aperture 22 (see FIG. 1), and assuming the far end of the tendon (not shown) is fixed in place, tension is applied to tendon 16, typically by use of a hydraulic jack. While applying this tension, wedges 24 and 26 are forced in place on both sides of tendon 12 within the wedge cavity defined by aperture 22. Once in place, teeth **24*a* and 26*a* of wedges 24 and 26 operate to lock tendon 12 in a fixed position with respect to anchor 20. Thereafter, the tension supplied by the hydraulic device is released and the excess tendon extending outward from anchor 20 is cut by a torch or other known device. Wedges 24 and 26 thereafter prevent tendon 12 from releasing its tension and retracting inward with respect to anchor 20**. Moreover, this tension provides additional tensile strength across the concrete structure.

As known in the art, metallic components within concrete structures may become exposed to many corrosive elements, such as de-icing chemicals, brackish water, and salt water. If this occurs, and the exposed portions of the anchor suffer corrosion, the anchor and/or its related parts may weaken. The most sensitive area responsive to these corrosive effects is the wedge cavity defined by aperture 22. Particularly, teeth **24*a* and 26*a* of wedges 24 and 26** are fairly delicate, yet of paramount importance in retaining the tendon under stress. Consequently, once the teeth deteriorate, the gripping effect of the wedges is diminished or eliminated and, hence, the tendon either partially or completely slips from the grasp of the anchor. This slippage may cause loss of the tension effects across the structure.

Various attempts have been made in the prior art to reduce or eliminate the potential for corrosion within the wedge cavity of the anchor. For example, U.S. Pat. No. 5,024,032, entitled "Post-Tensioning Anchor" and issued to Rodriguez on Jun. 18, 1991, discloses a post-tension anchor and cap. The cap friction fits with the anchor in an effort to enclose the wedge cavity from external materials. The friction-fitting cap includes tabs or so-called "ears" around which securing filaments are tied. The securing filaments are purported to retain the cap within a press-fit engagement of the anchor, thereby precluding corrosives or contaminants from reaching the wedge cavity of the anchor.

U.S. Pat. No. 4,918,887, entitled "Protective Tendon Tensioning Anchor Assembly" and issued to Davis et al. on Apr. 24, 1990, discloses the combination of an anchor plate, a sealing cap and a resilient sealing ring. The combination is used in an effort to seal the wedge assembly of the anchor from the external environment. The combination represents a relatively complicated configuration for a sealing cap wherein various locking fingers and a specially Shaped sealing ring are necessary in an effort to seal the wedge cavity of the anchor from external contaminants.

As yet another example, U.S. Pat. No. 4,773,198, entitled "Post-Tensioning Anchorages for Aggressive Environments", and issued to Reinhardt on Sep. 27, 1988, discloses an alternative anchor and sealing cap assembly. The sealing cap is provided with threads for threading into a lip of the anchor plate for fluid sealing. Alternative seals such as "snap rings, bayonet fittings or other" fittings are also discussed.

As yet a final example, U.S. Pat. No. 4,719,658, entitled "Hermetically Sealed Anchor Construction For Use In Post Tensioning Tendons", and issued to Kriofske on Jan. 19, 1988, discloses an anchor and "plug" for fitting to the anchor. The plug includes a grease fitting through which grease may be injected, thereby forcing it into the cavities surrounding the anchor.

Each of the prior,art references discussed above, as well as others known in the art, all purport to attempt to maintain the wedge Cavity of the anchor free of contaminants. Unfortunately, however, each of the efforts of the prior art have reflected various drawbacks. For example, many of the devices are highly complicated to manufacture and/or use. This increased complication significantly increases costs which, when spread over hundreds or thousands of devices, may significantly affect the total price for constructing the concrete structure. Moreover, the more sophisticated devices require greater skill and time expenditure during installation. Consequently, not only are costs of the device increased, but so are the risks of wrongful or erroneous use of the device. If the device is not properly implemented, the device may fail to achieve its intended objective.

It is therefore an object of the present invention to provide an improved method and sealing apparatus for use with an anchor assembly.

It is a further object of the present invention to provide such an apparatus and method for reducing the costs of manufacturing and installing the overall assembly.

It is yet another object of the present invention to provide such an apparatus and method such that the amount of steps necessary in constructing and installing the device are simplified and/or reduced.

It is further object of the present invention to provide such a method and apparatus such that the number of component parts are reduced.

Still other objects and advantages of the present invention will become apparent to those of ordinary skill in the art having reference to the following specification, together with its drawings.

SUMMARY OF THE INVENTION

In one embodiment, the present invention includes an apparatus for sealing an anchor retaining a tendon, whereby an end of the tendon extends from the anchor. The apparatus comprises a vessel member having a void and a rust inhibitor disposed within the void. Further, the apparatus includes a retaining member permanently affixed to the vessel member whereby the retaining member is punctured by the tendon end upon placing the vessel in sealed communication with the anchor.

In still other embodiments, the present invention may include further refinements. For example, the vessel of the present invention may further include an outer ridge mateable with the anchor wherein the retaining member is affixed along the outer ridge. As another example, the retaining member of the present invention may comprise polyethylene film. As yet another example, the retaining member of the present invention may comprise a transparent material.

Still other embodiments and features are described, as set forth in the following brief and detailed descriptions of the present invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

The preferred embodiment of the present invention and its advantages are best understood by referring to FIGS. 1–4 of the drawings, like numerals being used for like and corresponding parts of the various drawings.

Figure 1:
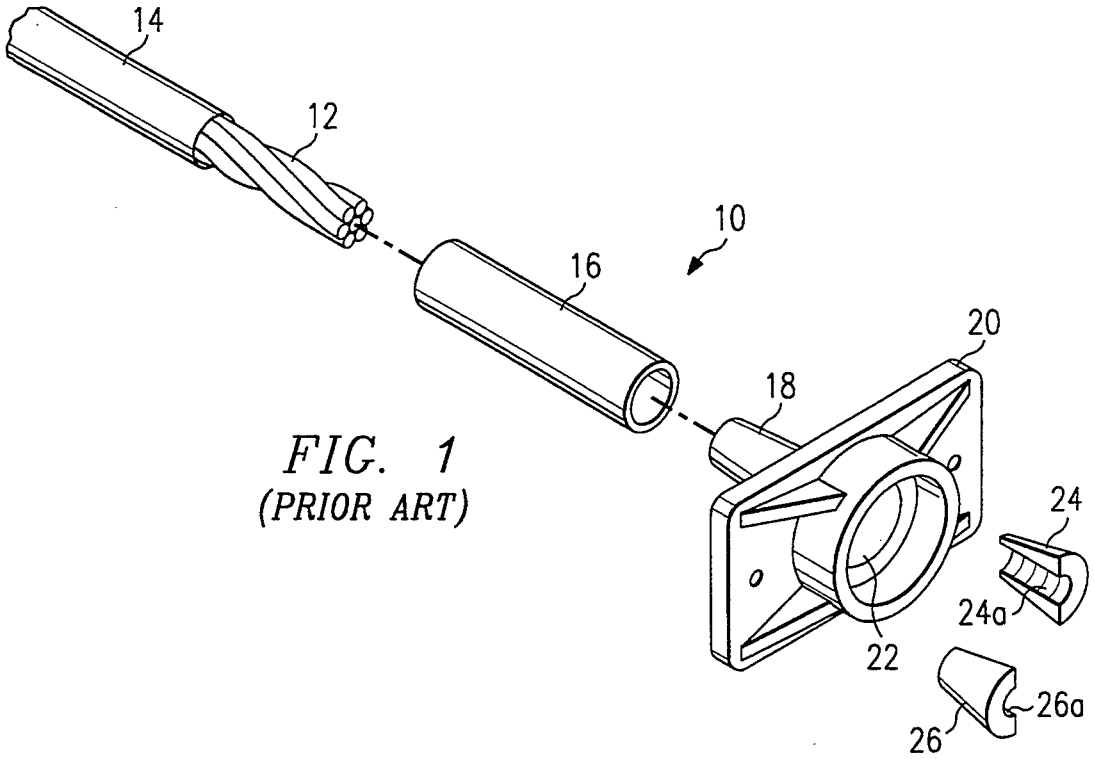
FIG. 1 (PRIOR ART)
FIG. 1 illustrates a perspective view of various prior art components in a post-tension system.
Figure 2:
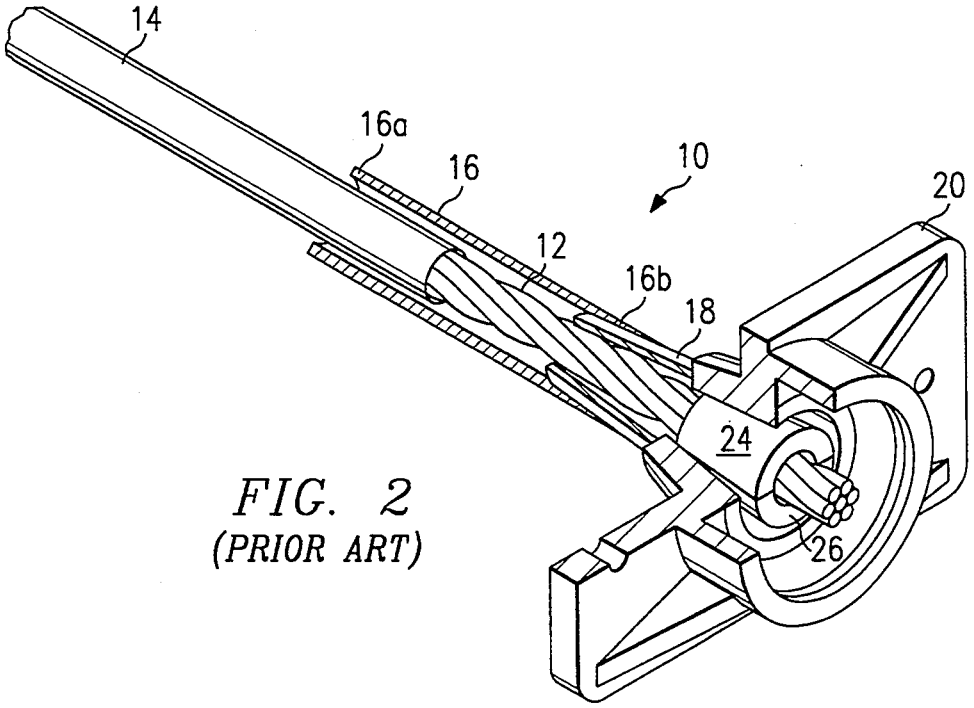
FIG. 2 (PRIOR ART)
FIG. 2 illustrates a perspective and assembled view of the various prior art components shown in FIG. 1.
Figure 3:
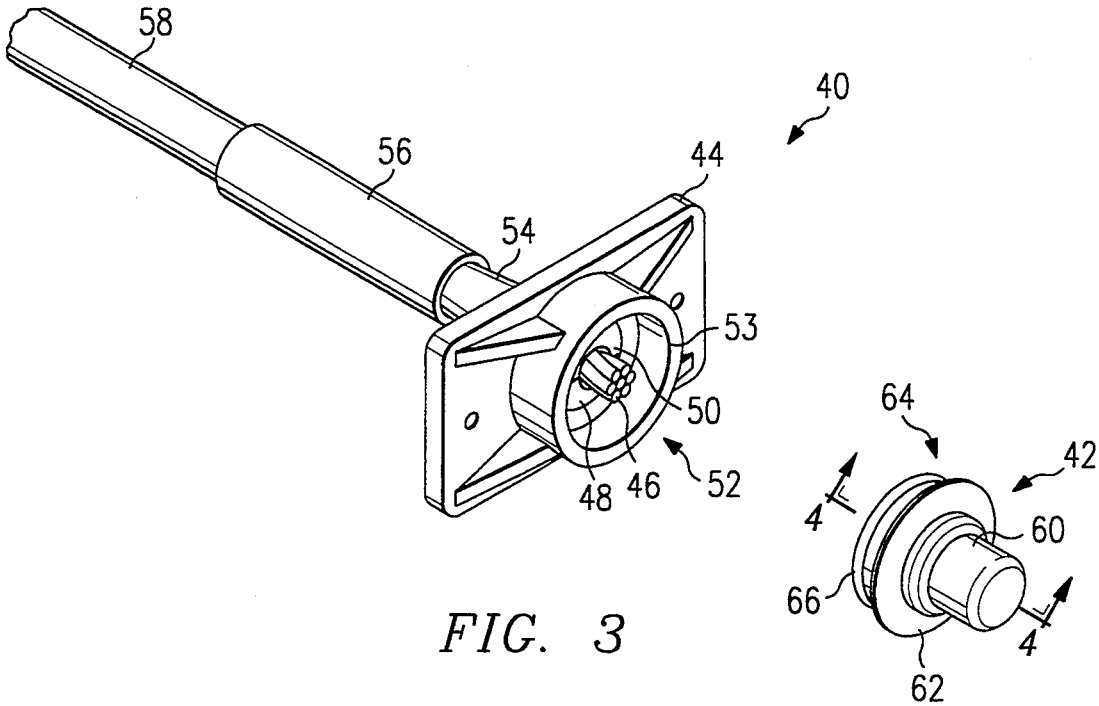
FIG. 3 illustrates a perspective view of an assembled anchor having a tendon extending therethrough and a sealing cap for use with the anchor in accordance with the present invention.

FIG. 3 illustrates a post-tension system 40 in accordance with the present invention. System 40 includes a novel and improved sealing cap 42 to be fitted in sealed relationship With an anchor system, such as those known in the prior art. For example, FIG. 3 illustrates, in addition to sealing cap 42, an assembled anchor system such as that shown above in FIG. 2. It should be understood, however, that the system shown in FIG. 3 is representative of only one example. Clearly, alternative types of anchor configurations may be used wherein it is desirable to seal the wedge cavity, or other retaining components, of an anchor.

The exemplary embodiment of FIG. 3 illustrates an anchor 44 supporting the end 46 of a tendon. The tendon is locked in place with respect to anchor 44 by wedges 48 and 50 disposed within the wedge cavity 52 of anchor 44. The volume including wedge cavity 52 is increased by a protruding lip member 53 ! extending outward from anchor 44. Anchor 44 also includes a rear tubular member 54 which communicates with an extension tube 56. In the preferred embodiment, extension tube 56 friction fits over rear tubular member 54. Moreover, extension tube 54 overlies a sheath 56 which encases a tendon (the end 46 of which is shown protruding outward from wedge cavity 52). Although not shown, the end of extension tube 56 overlying sheath 58 is sealed, by use of tape or other means.

In the preferred embodiment, sealing cap 42 is constructed of high-density polyethylene or polypropylene. Sealing cap 42 includes a vessel area 60 for storing a rust inhibitor as discussed in greater detail below. Moreover, sealing cap 42 includes an outer lip 62 which abuts with the outer rim of protruding lip member 53 once sealing cap 42 is connected to anchor 44. Sealing cap 42 further includes an outer ridge 64 (shown more fully in FIG. 4) and an O-ring seal 66.

Figure 4:
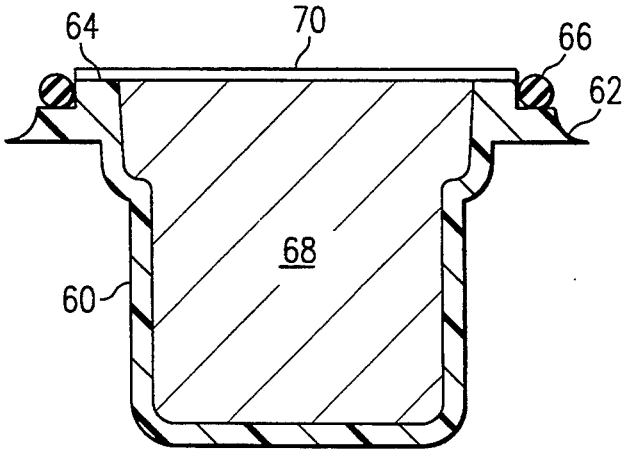
FIG. 4 illustrates a cross-sectional view of the sealing cap of FIG. 3.

With reference to FIG. 4, a cross-sectional view of sealing cap 42 is illustrated. From the perspective of FIG. 4, it may be appreciated that vessel 60 defines an interior void within cap 42. In the preferred embodiment, this interior void is filled with a viscous material or rust inhibitor 68, such as grease. Rust inhibitor 68 is chosen to eventually pack wedge cavity 52 and, hence, is selected to minimize the possibility of contaminants entering therein.

The cross-sectional view of FIG. 4 further illustrates a retaining member 70 which is permanently affixed to sealing cap 42 around outer edge 64. Retaining member 70 encloses rust inhibitor 68 within void 60 of sealing cap 42. In the preferred embodiment, retaining member 70 is constructed of a polyethylene film on the order of 0.004 to 0.006 inches in thickness. The use of a polyethylene film is preferred for various reasons. First, it is easily pierced as discussed in further detail below. Second, the polyethylene film may be transparent so that a user of sealing cap may view rust inhibitor 68 through the film, thereby ensuring that sealing cap 42 is properly filled. Third, polyethylene film is readily available in rolls and is relatively inexpensive. Fourth, the film is readily attached to cap 42 by heating, as described below.

In the preferred embodiment, first the body of manufacturing cap 42 is constructed, typically by an injection molded process. Next, rust inhibitor 68 is loaded into void 60. Finally, a strip of polyethylene film is placed in contact with outer edge 64 and over void 60. Heat is then applied around the entire perimeter of outer edge 64. This heat causes two effects. First, the heat causes the polyethylene film to adhere around outer edge 64, thereby sealing rust inhibitor 68 within the void of vessel 60. Second, the heat severs the remainder of the strip of polyethylene film from that portion covering void 60. Thus, in one manufacturing step, a resultant structure is created whereby retaining member 70 is created to encase rust inhibitor 68 within void 60. It should also be noted that by affixing retaining member 70 to the outermost portion of cap 42, the amount of volume within the void is maximized, thereby permitting a maximized amount of rust inhibitor 68 to be inserted therein.

Returning to FIG. 3, the operation and functionality of sealing cap 42 may now be better appreciated. Specifically, sealing cap 42 is inserted such that O-ring 66 abuts within protruding lip member of anchor 44. As this motion is accomplished, end 46 of the tendon contacts retaining member 70. As the force to insert sealing cap 42 into anchor 44 continues, end 46 of the tendon penetrates or punctures retaining member 70, thereby causing rust inhibitor 68 to pass within wedge cavity 52. Moreover, because retaining member 70 is preferably a polyethylene film, it is easily displaced within the void once it is punctured. Thus, the present invention provides a mechanism for automatically applying grease within wedge cavity 52 while concurrently sealing the wedge cavity due to the insertion of sealing cap 42 in place.

From the above, it may be appreciated that the sealing cap of the present invention provides numerous advantages. For example, the cap may be filled with rust inhibitor and sold in that manner such that the additional use of grease to seal an anchor cavity at the work site is unnecessary. Moreover, the preferred process of utilizing a thin film as a retaining member provides a minimal number of parts in connection with the sealing cap. This reduction in parts simplifies the manufacturing process and, hence, reduces manufacturing costs for both parts and labor. Still another advantage is that the retaining member associated with the sealing cap is permanently affixed in place, thereby retaining the rust inhibitor within the cap until the cap is inserted in place into its respective anchor. Consequently, rust inhibitor leakage is less likely in shipping and handling of the device. Finally, the use of a thin film around the outer edge of the sealing cap permits various different types of construction configurations to be utilized for the cap without departing from the spirit and scope of the present invention. Thus, these exemplary benefits, as well as the embodiments discussed herein, illustrate that while the present invention has been described in detail, various substitutions, modifications or alterations could be made to it without departing from the scope of the invention as defined by the following claims.

What is claimed is:

1. An apparatus for sealing an anchor retaining a tendon, whereby an end of said tendon extends from said anchor, comprising:

a vessel member having a void and an exterior outer edge along the perimeter of said vessel member;

a rust inhibitor disposed within said void; and a retaining member permanently affixed around said exterior outer edge of said vessel member, whereby said retaining member is punched by said tendon end upon placing said vessel in sealed communication with said anchor.

2. The apparatus of claim 1 wherein said vessel further comprises an outer ridge mateable with said anchor, and wherein said retaining member is affixed along said outer ridge.

3. The apparatus of claim 1 wherein said retaining member comprises polyethylene film.

4. The apparatus of claim 1 wherein said retaining member comprises transparent film.

5. The apparatus of claim 1 wherein said vessel comprises high density polyethylene.

6. The apparatus of claim 1 wherein said vessel comprises a cup-shaped member.

7. The apparatus of claim 1 wherein said vessel further comprises an outer ridge mateable with said anchor, and further comprising a sealing member disposed along said outer ridge.

8. The apparatus of claim 1 wherein said retaining member is approximately 0.004 to 0.006 inches in thickness.

9. An apparatus for sealing an anchor retaining a tendon, whereby an end of said tendon extends from said anchor, comprising:

a vessel member having a void and an outermost exterior outer ridge which is mateable with said anchor;

a rust inhibitor disposed within said void; and a polyethylene film retaining member permanently affixed along said outer ridge of said vessel member, whereby said retaining member is punctured by said tendon end upon mating said vessel to said anchor.

10. The apparatus of claim 9 wherein said polyethylene film retaining member comprises a transparent material.

11. The apparatus of claim 9 wherein said polyethylene film retaining member is approximately 0.004 to 0.006 inches in thickness.

12. An apparatus for anchoring a tendon in concrete, comprising:

an anchor having a first opening for receiving an end of a tendon and a second opening communicating with said first opening and for permitting said tendon to extend outward from said anchor; and at least one wedge for retaining said tendon end in affixed position with respect to said anchor; and an apparatus for sealing said second opening of said anchor; comprising:

a vessel member having a void and an exterior outer edge along the perimeter of said vessel member;

a rust inhibitor disposed within said void; and a retaining member permanently affixed around said exterior outer edge of said vessel member, whereby said retaining member is punctured by said tendon end upon placing said vessel in sealed communication with said anchor.

13. The apparatus of claim 12 wherein said retaining member is approximately 0.004 to 0.006 inches in thickness.

* * * * *

UNITED STATES PATENT AND TRADEMARK OFFICE

CERTIFICATE OF CORRECTION

PATENT NO. : 5,440,842

DATED : August 15, 1995

INVENTOR(S) : Felix L. Sorkin

It is certified that error appears in the above-indentified patent and that said Letters Patent is hereby corrected as shown below:

Col. 2, ln. 38, delete "Shaped", insert --shaped--.

Col. 2, ln. 58, delete "Cavity", insert --cavity--.

Col. 4, ln. 18, delete "!".

Signed and Sealed this

Thirtieth Day of January, 1996

*Attest:*

*Attesting Officer*

BRUCE LEHMAN

*Commissioner of Patents and Trademarks*